United States Patent [19]

Christian

[11] Patent Number: 4,504,222

[45] Date of Patent: Mar. 12, 1985

[54] SCREW CONVEYER AND FURNACE

[75] Inventor: Robert F. Christian, San Francisco, Calif.

[73] Assignee: Jude Engineering, Inc., San Francisco, Calif.

[21] Appl. No.: 531,700

[22] Filed: Sep. 13, 1983

[51] Int. Cl.[3] ..... F26B 9/18; F23N 5/24

[52] U.S. Cl. ..... 432/139; 432/175; 34/182; 110/110; 110/228

[58] Field of Search ..... 110/110, 108, 222, 224, 110/227, 228, 255, 257, 275, 276; 34/182; 432/139, 175

[56] References Cited

U.S. PATENT DOCUMENTS

| | | | |
|---|---|---|---|
| 2,220,193 | 11/1940 | Ahlmann | 34/182 |
| 2,517,833 | 8/1950 | Bourland | 34/182 |
| 3,360,865 | 1/1968 | Galle et al. | 34/182 |
| 3,646,689 | 3/1972 | Kuchenthal et al. | 34/182 |
| 3,701,713 | 10/1972 | Bennett et al. | 34/182 |
| 3,905,127 | 9/1975 | Davis | 34/182 |
| 4,089,277 | 5/1978 | Paul | 110/228 |
| 4,156,392 | 5/1979 | Bayeh | 110/228 |
| 4,276,701 | 7/1981 | Takacs et al. | 34/182 |
| 4,331,085 | 5/1982 | Tyer et al. | 34/182 |
| 4,351,250 | 9/1982 | Chartrand et al. | 110/228 |
| 4,373,702 | 2/1983 | Jayaraman et al. | 432/175 |
| 4,391,205 | 7/1983 | Morey | 110/224 |
| 4,430,949 | 2/1984 | Ekenberg | 110/110 |

FOREIGN PATENT DOCUMENTS

| | | | |
|---|---|---|---|
| 2143462 | 3/1973 | Fed. Rep. of Germany | 34/182 |

*Primary Examiner*—Henry C. Yuen

*Attorney, Agent, or Firm*—Murray, Whisenhunt & Ferguson

[57] ABSTRACT

A screw conveyer is provided with a heat insulating casing (16) and with a plurality of pipe burners (30) arranged between a perforated bottom plate (17) of the casing and a housing (13) which contains the screw conveyer and is used for drying waste products which the conveyer feeds to a furnace (27).

1 Claim, 2 Drawing Figures

SCREW CONVEYER AND FURNACE

BACKGROUND OF THE INVENTION

This invention relates to a screw conveyer especially for heating products to be incinerated and feeding them to a furnace.

Waste products for incineration commonly have a high moisture content and it would be more efficient to remove much of this moisture before feeding the products to the furnace. For example it would be desirable to reduce the moisture content to below 50% by weight of the product.

OBJECT OF THE INVENTION

The main object of the invention is to effect simultaneous conveying and heat treatment of a product.

SUMMARY OF THE INVENTION

According to one aspect of the invention I provide a screw conveyer comprising a rotary shaft, screw flite means surrounding and attached to the shaft, a housing surrounding at least the major part of the length of the screw flite means, inlet and outlet openings at opposite ends of the housing for products to be heated, an insulation casing outside the housing, a plurality of pipe burners between the housing and casing extending parallel to the axis of the shaft, and exhaust means for exhausting burnt gases from the housing.

In a particular embodiment of the invention a furnace has an inlet opening for products to be incinerated and a screw conveyer as defined above is inclined with its upper end having its outlet opening connected to the inlet opening of the furnace.

DESCRIPTION OF PREFERRED EMBODIMENT

Figure 1:
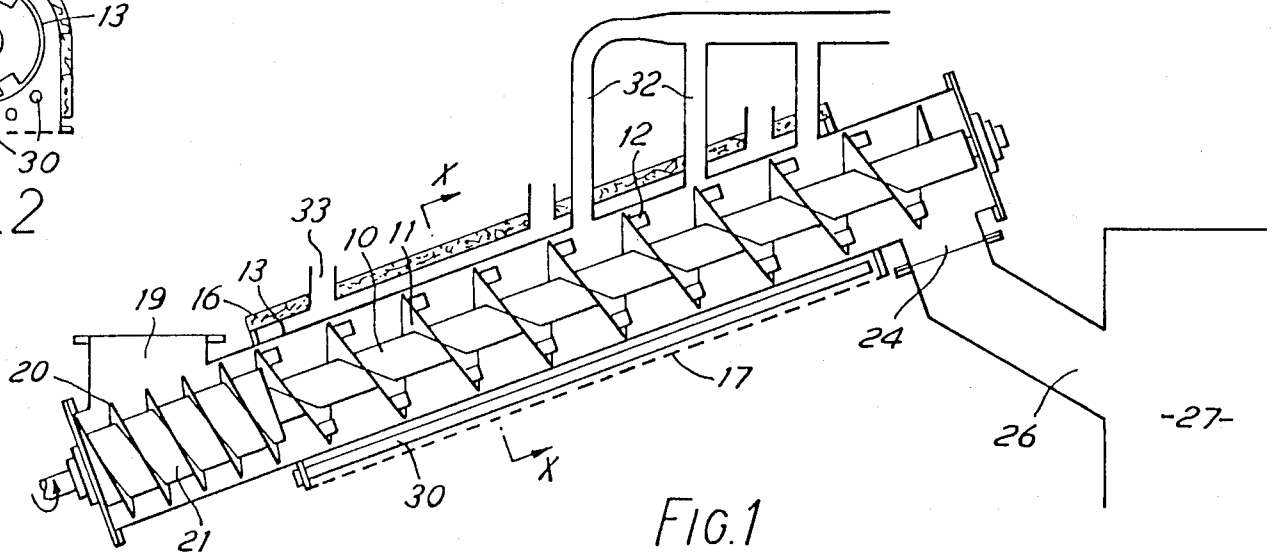
FIG. 1 is a vertical sectional view of a screw conveyer and adjacent part of a furnace.
Figure 2:
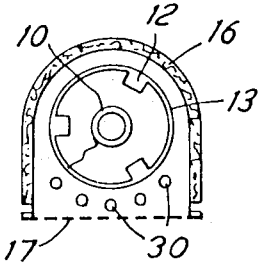
FIG. 2 is a sectional view on the plane X—X on FIG. 1.

The screw conveyer is inclined and comprises a rotary shaft 10 which may be hollow. The shaft 10 is mounted in suitable bearings and driven by gearing and a motor which need not be illustrated or described as these are of well known construction. Mounted on the shaft 10 and extending over the major part of the length thereof is a screw flite 11 having blades 12 to assist in agitating the product being treated.

Closely surrounding the screw flite is a tubular housing 13.

Surrounding the housing 13 and spaced from it is a heat insulated jacketted casing 16 in the form of an inverted U-shaped hood and a bottom perforated cover plate 17.

The housing 13 extends out of the casing 16 at both ends. At the lower end an inlet opening 19 is provided for entry of products to be treated and a feed screw 20 on a tubular support 21 is fixed to the shaft 10. At the upper end the housing has an outlet opening 24 for discharge of heated and dried products and the opening 24 is connected by a discharge chute 25 to the inlet opening 26 of a furnace 27.

A plurality of pipe burners 30 preferably at least three or for example five as shown are mounted below the housing 13 between the latter and the perforated bottom 17. These burners direct their flames at the lower part of the housing 13. The burners extend parallel to the axis of the shaft 10 along the major part of the screw flite. Air for combustion enters through the perforated bottom plate 17 and moisture from the product within the housing 13 exits through a plurality of exhaust ducts 32 which are arranged along part of the length of the housing near its upper end. Burnt gases exit through exhaust ducts 33 leading from the combustion chamber between the housing 13 and casing 16.

I claim:

1. A screw conveyer comprising (a) a rotary shaft carrying screw flite means surrounding and attached to the shaft (b) an imperforate tubular housing surrounding at least the major part of the length of the screw flite means (c) inlet and outlet openings at opposite ends of the housing for products to be heated (d) an inverted U-shaped heat insulation casing over said housing and spaced therefrom, said casing being open at its under part for inlet of ambient air (e) a plurality of pipe burners arranged below the housing extending parallel to the axis of the shaft along said major part of the length of the screw flite means (f) first exhaust duct means (32) connected to the housing and communicating with the interior of the housing for exit of moisture (g) second exhaust duct means (33) communicating with the space between the housing and the casing for exhausting burnt gases (h) the shaft, housing and casing are inclined to the horizontal with the inlet opening lowermost (i) the shaft extends out of the casing at the inlet end and the shaft carries a feed screw at the inlet end outside the casing below the inlet opening (j) the screw flite carries mixing blades (12)

(k) at least three side pipe burners are provided spaced apart from each other below the housing.

* * * * *